United States Patent [19]

Olpp et al.

[11] Patent Number: 4,632,408

[45] Date of Patent: Dec. 30, 1986

[54] SKI FOR THE HANDICAPPED

[75] Inventors: Hans Olpp, Urach; Heini Braun, Deggingen, both of Fed. Rep. of Germany

[73] Assignee: GFL Formteile-und Larmschutz Technik GmbH & Co., Fed. Rep. of Germany

[21] Appl. No.: 685,688

[22] Filed: Dec. 24, 1984

[30] Foreign Application Priority Data

| | | | |
|---|---|---|---|
| Dec. 24, 1983 | [DE] | Fed. Rep. of Germany | 8337324[U] |
| Jan. 28, 1984 | [DE] | Fed. Rep. of Germany | 8402458[U] |
| Sep. 21, 1984 | [EP] | European Pat. Off. | 84111311.1 |

[51] Int. Cl.[4] ..... B62B 13/04

[52] U.S. Cl. ..... 280/12 K; 280/16

[58] Field of Search ..... 280/601, 12 K, 12 L, 280/12 L, 12.11, 12 C, 12 F, 12 R, 18, 24, 25, 480; 104/173 R, 173 ST; 441/65–68, 72, 73; 114/249–251

[56] References Cited

U.S. PATENT DOCUMENTS

| | | | |
|---|---|---|---|
| 3,325,179 | 6/1967 | Bissett | 280/12 K |
| 3,600,000 | 8/1971 | Bergstrom | 280/18 |
| 3,833,234 | 9/1974 | Schreiber | 280/21 A X |
| 4,193,609 | 3/1980 | Bissett | 280/12 K |
| 4,271,762 | 6/1981 | Wiegand | 104/69 |
| 4,353,573 | 10/1982 | Morgan | 280/12 R |

FOREIGN PATENT DOCUMENTS

| | | | |
|---|---|---|---|
| 284641 | 9/1970 | Austria . | |
| 68582 | 4/1915 | Switzerland | 280/12 K |
| 479317 | 11/1969 | Switzerland . | |

*Primary Examiner*—John J. Love
*Assistant Examiner*—Michael Mar
*Attorney, Agent, or Firm*—Jones, Tullar & Cooper

[57] ABSTRACT

A ski for the handicapped including a seating shell mounted on a mono-ski or a pair of parallel skis. The seating shell is mounted on either the mono-ski or the parallel skis. The seating shell includes at least one seating area and a longitudinally spaced leg supporting area. A tow and supporting bar assembly is provided which is pivotably mounted to the seating shell and engages, when desired, the ground. The tow and supporting bar assembly includes a tow bar holder which releasably engages with a T-bar device.

26 Claims, 13 Drawing Figures

34
5
4
1
12
6
13
23', 23''
22
18
3
16
11
10
2
2'
15
19
20
17
16'''
21
7
31
33
9

51
52
50

SKI FOR THE HANDICAPPED

TECHNICAL FIELD

The present invention relates to a ski for the handicapped with a seating shell having at least one seating area and a further area, disposed in front of the seating shell in the longitudinal direction of the ski, for supporting the legs. Supporting parts are pivotably attached to both sides of the seating shell, the ends of which, in the pivoted position, are supported on the ground to prevent tipping.

PRIOR ART

An apparatus of this kind is known from German Pat. No. 277983, although there it is called a "sports sled". Its seating shell is quite flat, and a crossbar is provided for the shoes to rest on. The knee area, in particular, is entirely in the open. For lateral support in order to prevent tipping, and for braking as well, hand-operated supporting parts are pivotably articulated on the shell. This sports equipment is practically unsuitable for the handicapped, especially for paraplegics, who while at the standstill and when starting are unable to use their feet to prevent tipping, and who must have their hands free for operating the bar of a ski lift and for other manipulations and so cannot hold onto the supporting parts.

A further, similar apparatus is also known from U.S. Pat. No. 4,310,169, in which the seating shell is secured directly to a mono-ski and spaced only slightly apart from it. The legs can be firmly strapped to the mono-ski in the area of the knees by a belt. The athlete here is relatively unprotected; skiing through relatively deep snow is impossible because the seating shell is so close to the ground, and even on a smooth slope snow continually gets into the seating shell. Furthermore, "wedeln", that is, skiing downhill in short swings back and forth at a constant speed, is difficult to achieve with good balance, because the athlete's center is gravity is so low to the ground.

From U.S. Pat. Nos. 4,193,609 and 3,325,179 and Swiss Pat. No. 479317, a skibob which is ideally suited for "wedeln" is known. However, because no protection for the legs is provided, parapelgics and those whose legs have been amputated cannot use this equipment.

U.S. Pat. No. 3,833,234 discloses a sled with three skis and a seating shell comprising an upper and a lower part. Athletic skiing, in which centrifugal force during "wedeln" is compensated for by leaning considerably away from the vertical, is impossible with this sled.

From French Pat. No. 816334 and U.S. Pat. No. 4,114,912, skiing apparatus with fixed lateral support runners are known. But these models, too, are unsuitable for the severly handicapped because they lack the required protection for the legs.

It is known to use a sled mounted on two skis in order to transport handicapped persons. It is hardly possible for the handicapped person himself, however. to use this equipment for skiing, and in particular an athletic "wedeln" cannot possibly be accomplished.

From Austrian Pat. No. 284641, an apparatus is known for attaching sleds to tow lifts, in which a loop of a belt can be opened via an opening button of a lock.

OBJECT AND SUMMARY OF THE INVENTION

It is an object of the present invention to provide a way to enable persons who are handicapped in terms of the mobility of their legs to engage in athletic skiing activity. Accordingly, the invention is direct to providing the simplest and safest possible equipment with which even the handicapped, such as paraplegics, can ski.

This object is attained by means of a ski for the handicapped embodied in accordance with the invention. The invention also relates to various advantageous improvements to this equipment.

It has been found that with this type of ski or skiing equipment, even paraplegics whose lower body is completely paralyzed can ski down any ski slope, even if it is bumpy or covered with deep snow. All that is required is a training period of a few days. Control is accomplished by shifting the weight, if need be with the aid of ski crutches—that is, small skis attached either fixedly or movably to short crutches which are used from the sitting position in the seating shell.

A secure upright position of the mono-ski even while at a standstill is possible, without requiring that the handicapped skier use his hands to support himself, because of the design of the tow and support bar. This element is embodied by two supporting parts articulated onto both sides of the seating shell and joined to one another via crossbars. In a position of readiness, the tow and support bar is pulled away from the seating shell by means of a spring, by the ends of the bar towards the rear in the skiing direction, in such a manner that the ends of the supporting parts rest on the ground.

The danger of accidents is lessened substantially if the tow bar holder can be lowered at least partially in a housing by being pivoted counter to the direction of skiing.

Unhindered "wedeln" is made possible by providing means on the seating shell for arresting the tow and support bar in the position for skiing; in this position, the two and support bar and the supporting parts predominantly rest on the seating shell.

A considerable increase in stability, even on a soft surface, can be attained by providing that the end area of the supporting parts is pivotable via a joint so as to rest against the underpart of the shell. In the readiness or waiting position, this end area can be pivoted outward to increase the distance between the supports and the vertical of the center of gravity, while when in tow and support bar is in the arrested position for starting to ski the end area rests on the underpart of the shell.

The invention will now be described in detail in terms of preferred exemplary embodiments shown in the drawings.

DESCRIPTION OF THE PREFERRED EMBODIMENTS

Figure 1:
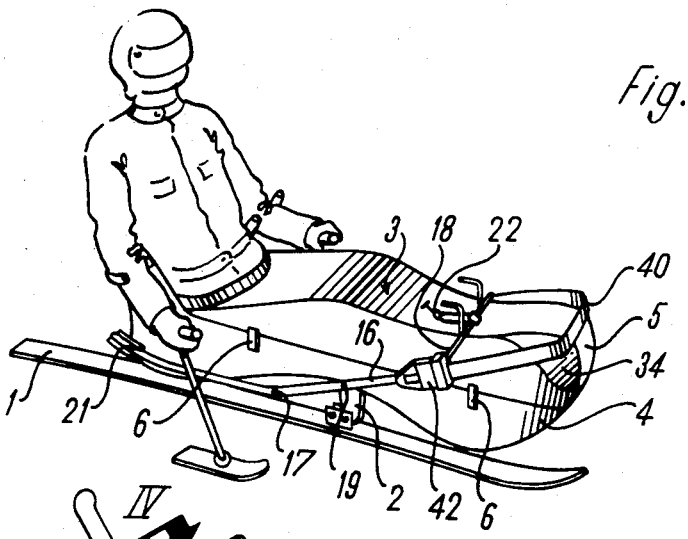
FIG. 1 illustrates a first exemplary embodiment of the invention.

A seating shell 3 is attached via a strut 2 to a single or mono-ski 1, such that it is articulated in the longitudinal plane. The seating shell 3 comprises a lower portion 4 and an upper portion 5. The upper portion is removable for entering and leaving the shell and can be arrested on the lower portion 4 by means of locking brackets 6. The rear portion of the seating shell 3 is the seating area 7, with a side panel 31 and a back panel 33 which are extended upward approximately as far as the armpits of a person seated in the seating shell 3. The seating area 7 is supported on the mono-ski 1 by a shock absorber 9. The strut 2 and the mono-ski 1 are joined by a joint 2' which enables tipping of the seating shell 3 relative to the mono-ski 1 about an axis that is orthogonal to the mono-ski 1.

For use, a person takes a seat in the seating shell 3 (see FIG. 1). To facilitate this and improve stability, the bottom of the seating shell 3 is not horizontal but instead is molded in such a way as to correspond to being seated on a flat surface with the knees draw up somewhat; in other words, it includes a somewhat elevated support area 10 for the backs of the knees. The upper portion 5 is embodied correspondingly higher in the area 11. The foot area 12 accomodates the feet, and a corresponding enlargement of the upper portion 5 at 13 is capable of receiving the ends of the feet as well as a blanket or other items, if such items must or should be carried along. The upper portion 5 has flattened areas 34 toward the front, which are oblique on the sides, so that in the event of an upset, the apparatus will not become buried in the snow because of some corner or edge that would otherwise be present.

After the upper portion 5 is removed, a person, even a paraplegic, can take a seat in the seating shell 3 (see FIG. 1). The upper portion 5 is then arrested on the lower portion 4 again by means of the locking brackets 6. By shifting his weight and using ski crutches for support, a person can now ski.

Figures 2, 7:
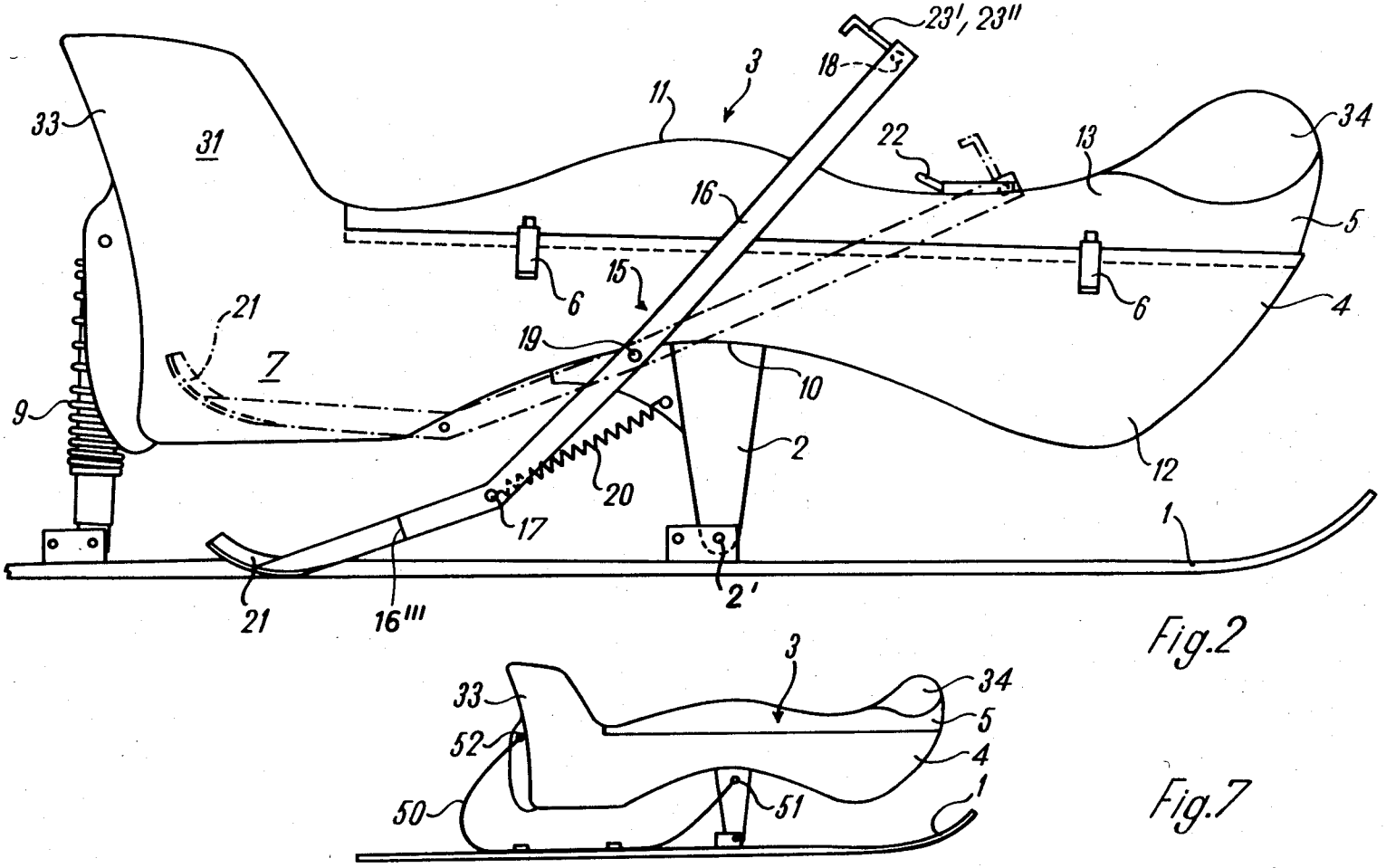
FIG. 2 is a side view of the exemplary embodiment of FIG. 1.
FIG. 7 illustrates a second exemplary embodiment of the invention.

The ski for the handicapped has a tow and support bar 15 (see FIG. 2). This tow and support bar 15 comprises two supporting parts 16 at both sides of the seating shell 3. They are both joined together via crossbars 17 and 18. This entire tow and support bar 15 comprising the two supporting parts 16 and the two crossbars 17 and 18 is articulated at 19 on both sides of the seating shell 3 is biased by a spring 20, which is disposed between the support 2 and the crossbar 17, into the readiness or waiting position shown, in which the ends of the supporting parts 16 press against the ground and thus support the ski for the handicapped. The ski accordingly is capable of standing on the ground on its own, without being supported by the handicapped person. To widen the base on which it stands still further, the lower end area of the supporting parts 16 can be spread outward by a respective joint 16''' (see FIG. 2) or a joint 16''' and rod linkage 16''' (see FIGS. 8–10). At the same time, better contact of the supporting parts 16 on the lower portion 4 in the skiing or operating position can be attained thereby. To this end, the rearward ends 21 of the supporting parts are pulled upward counter to the force of the spring 20 (compare FIG. 1 with the position in FIG. 2 indicated by dot-dash lines). The tow and upport bar 15 is now held in this position by a locking element 22, which the crossbar 18 "snaps" into, and which can be released once again by means of a single manipulation.

Figure 3:
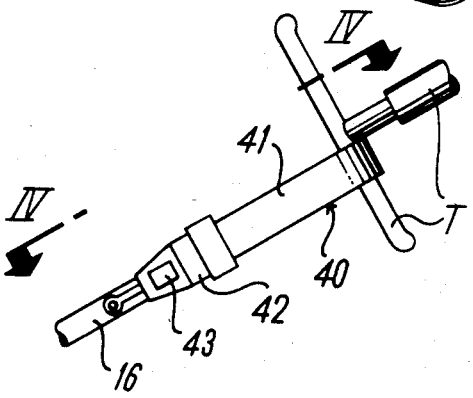
FIG. 3 illustrates a first embodiment of a tow bar holder.
Figure 4:
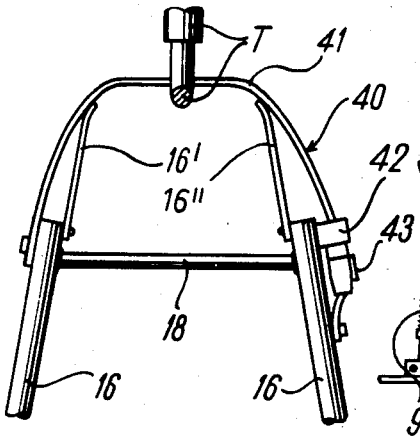
FIG. 4 is a view of the tow bar holder of FIG. 3 seen in the direction of the line IV—IV of FIG. 3.

To insert a T-bar of a tow lift, a tow bar holder 40 is provided (see FIGS. 3, 4) on the upper ends of the supporting parts 16, formed by a belt 41. This holder has a lock 42, which in a manner similar to the seat belt of an automobile is easily opened by pressing on a button 43. It is held in the tensed position by means of two bars 16', 16'' made of spring steel.

Figure 5:
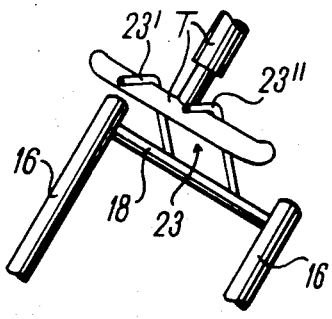
FIG. 5 illustrates another embodiment of a tow bar holder.

Alternatively, a tow bar holder 23 (FIG. 5) may be embodied such that two hooks 23', 23'' are attached to the upper ends of the supporting parts 16. The T-bar of the tow lift is inserted into these hooks 23', 23''.

Figure 6:
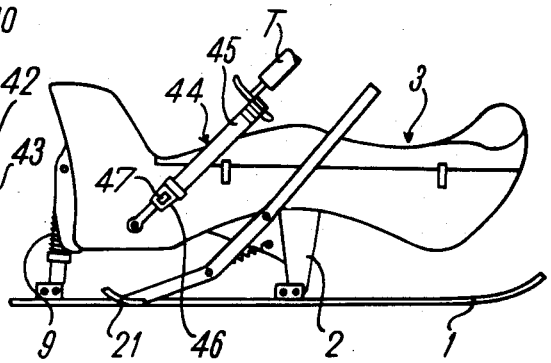
FIG. 6 illustrates a further embodiment of a tow bar holder.

As shown in FIG. 6, a tow bar holder 44 can also be attached directly to the seating shell 3. This holder is embodied by the belt 45 and a lock 46, which can be opened by pressing on the button 47.

In the exemplary embodiments of the ski for the handicapped according to FIG. 7, the seating shell 3 is held on the mono-ski 1 by a spring 50 embodied in the form of a band of steel or, to reduce the weight, of fiberglass- or carbon-fiber-reinforced plastic. This spring 50 is articulated on the seating shell 3 in the vicinity of the back panel 33 and approximatly centrally on the lower portion 4 and 51 and 52.

Alternatively to the fastening possibilities shown, FIG. 1 may also be modified such that the shock absorber is embodied by a C-shaped spring.

The seating shell 3 is fabricated of carbon-fiber- or fiberglass-reinforced plastic, in order to provide impact damping.

Figure 8:
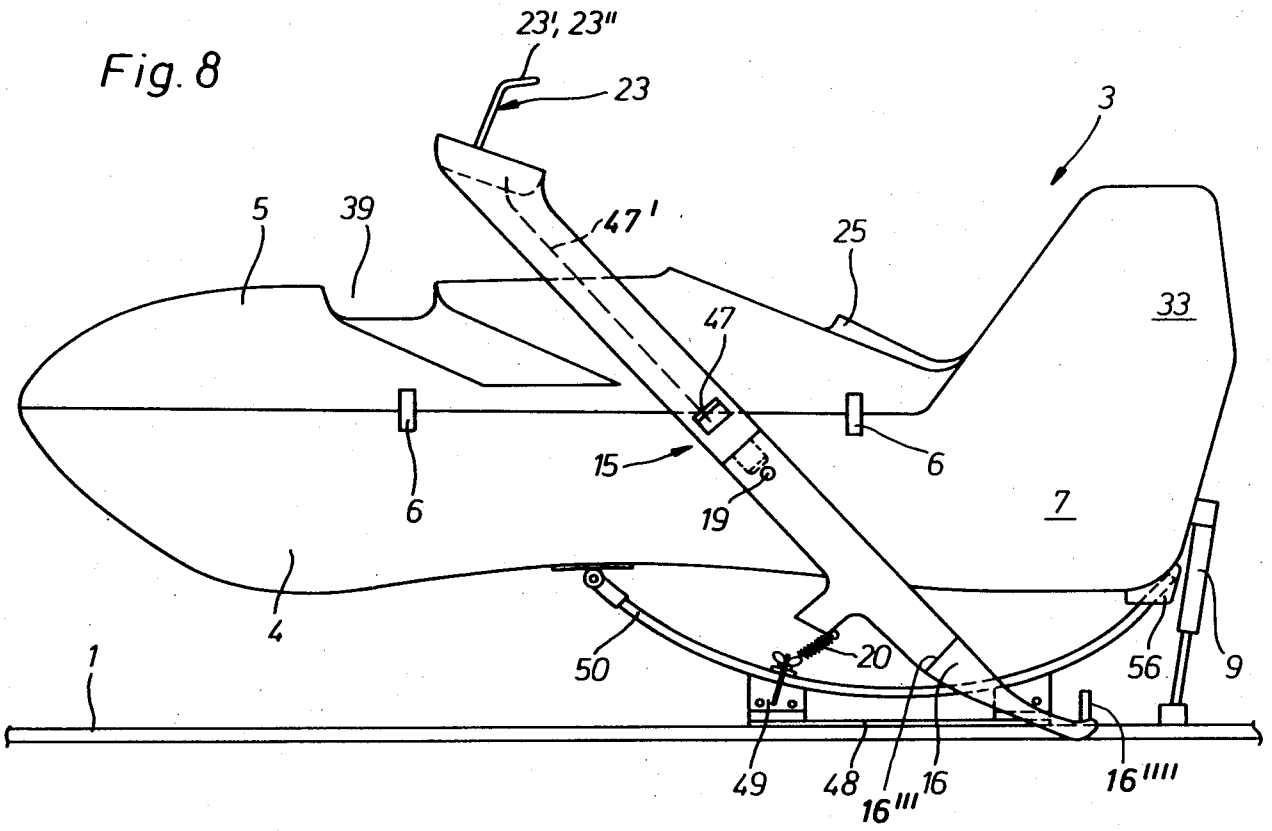
FIGS. 8 and 9 are two side views of a further embodiment of the invention.
Figure 9:
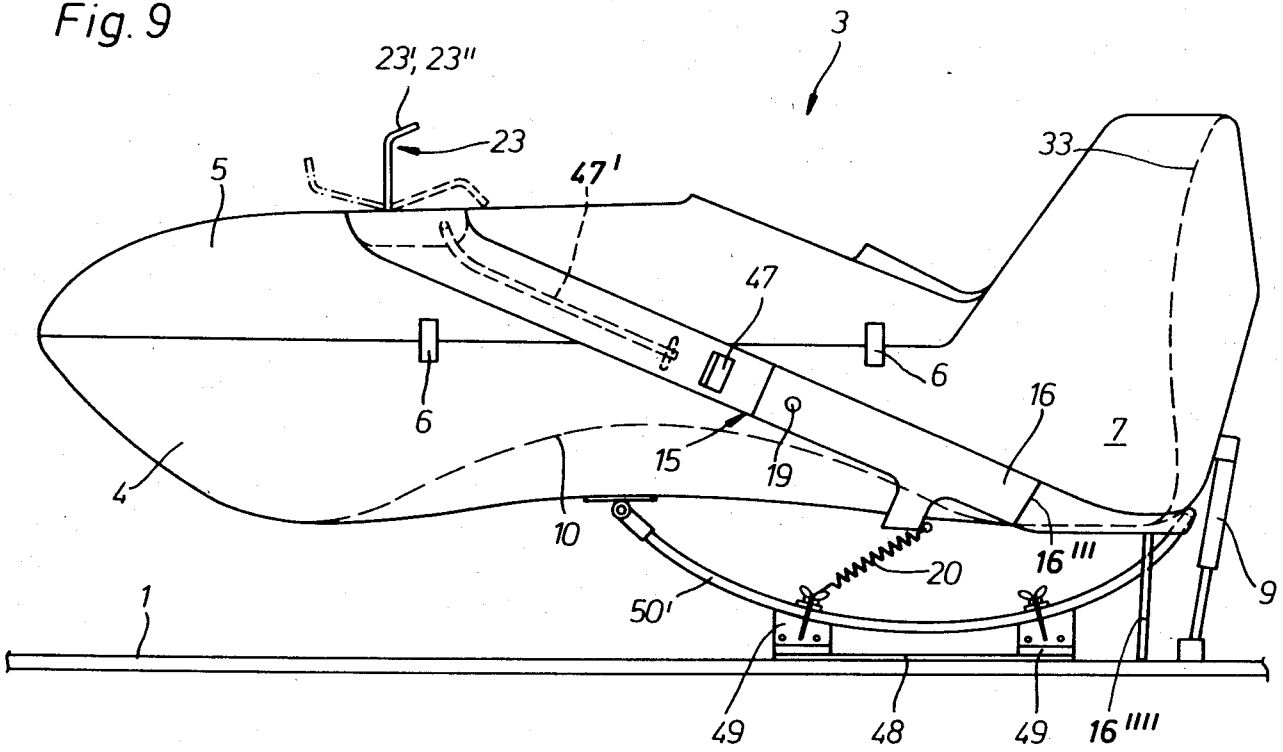

In the exemplary embodiment shown in FIGS. 8 and 9, the spring 50 is in the form of an arc segment, with one end articulated privotably about a shaft at right angles to the longitudinal axis, approximately centrally on the bottom of the lower portion 4. The free end is guided longitudinally displaceably in a guide 56 in the rounded transition between the bottom and the back panel 33 of the lower portion 4. The guide surface is embodied such that it is wear-resistant and slides well.

The mono-ski 1 is adjustably connected with the spring 50 by two vibration dampers 49 disposed axially spaced apart from one another. To vary the sliding properties of the mono-ski 1 for disabled skiers of not only varying body weights but also varying skiing abilities, the distance between the vibration dampers 49 and their longitudinal disposition on the mono-ski 1 is adjustable within wide limits by means of ad adjusting rail 48 provided on the mono-ski 1.

At the upper end of the supporting part 16, a curved tow bar holder 23 is mounted on both sides via an easily releasable plug connection. The releasing device for the tow bar holder 23, with its hooks 23' and 23'', which is actuatable by means of a button 47 via a Bowden cable 47' or a rod linkage (not shown), is built into this plug connection. As shown in FIG. 9, these hooks 23', 23'' can be pivoted away in the skiing direction (see dot-dash lines) to unlock the T-bar of the tow lift, while to avoid injuries while sking downhill they can be folded away counter to the skiing direction, perhaps even being lowered at least partially within the tow bar holder 23.

To further reduce the danger of injury, a receiving groove 39 for the tow bar holder 23 is provided in the upper portion 5; in the position for downhill skiing, the tow bar holder 23 is moved into this groove 39. In the starting and waiting position, the lower ends of the supporting part 16 rest on the ground, because of the pivoting action of the spring 20, and keep the ski for the handicapped in the vertical position (FIG. 8), while in the skiing position the lower ends of the supporting part 16 rest on the lower portion 4 as well, in a streamlined and accident-proof manner.

To make is more difficult for snow and water to get into the seating shell 3, the upper edge of teh upper portion 5 is provided with a water deflector 25, and the edge simultaneously serves to support the chest of paraplegics.

Figure 10:
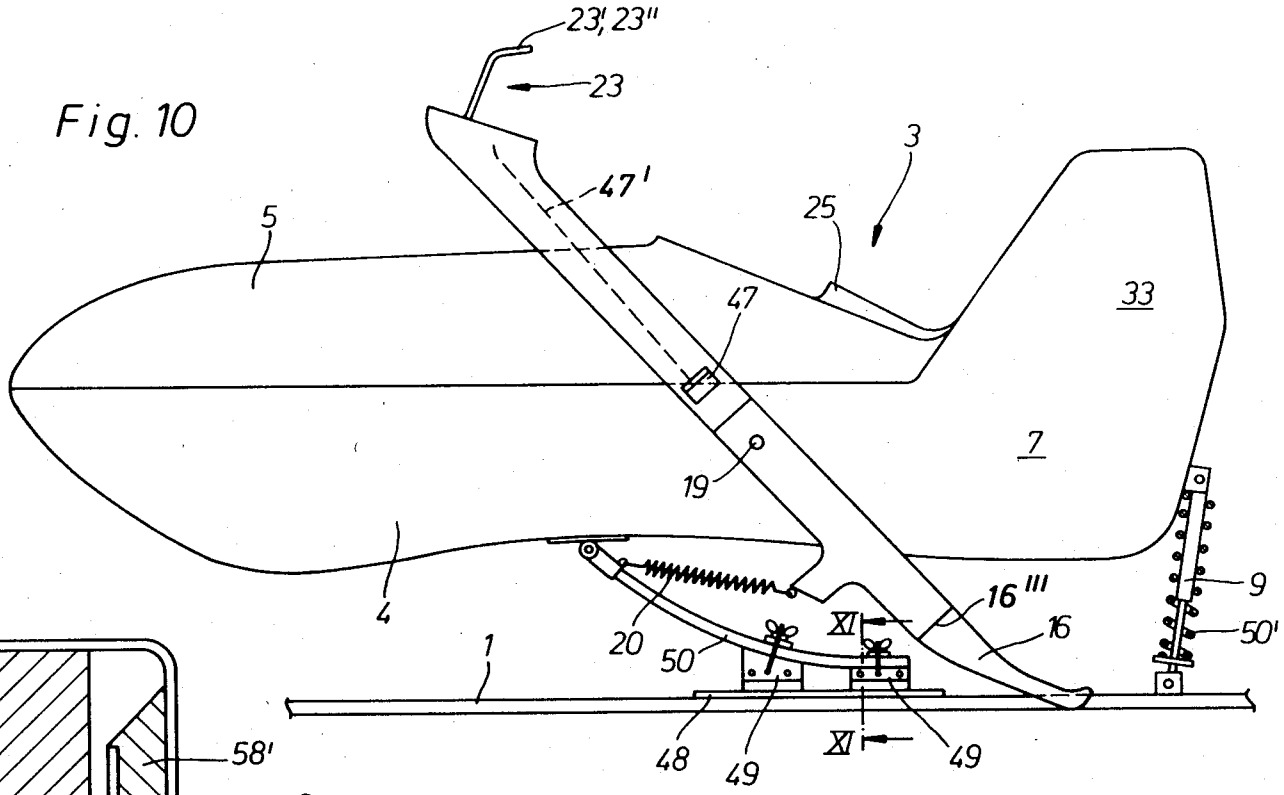
FIG. 10 illustrates still another exemplary embodiment of the invention.

In the further exemplary embodiment shown in FIG. 10, the spring 50 is embodied shorter and it does not support itself with its free end on the lower portion 4. Instead, a shock absorber 9 and an additional spring 50' are disposed on the rear end of the lower portion 4 between the lower portion 4 and the mono-ski 1.

Figure 11:
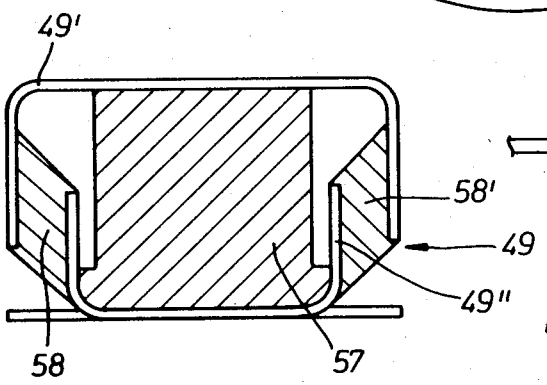
FIG. 11 is a section taken along the line XI—XI of FIG. 10 through a resilient bearing.

In FIG. 11, the vibration damper 49 is shown in cross section. It has two U-shaped rails 49' and 49'', of different widths, the openings of which face one another. An elastomer or rubber bridge 57, 58, 58' is provided between each of the base parts and the arms, and there is some space at least partway between the arms of the rail 49'' and the bridge 57, so as to attain greater rigidity and damping in the longitudinal direction as compared with tipping about the transverse axis.

Figure 12:
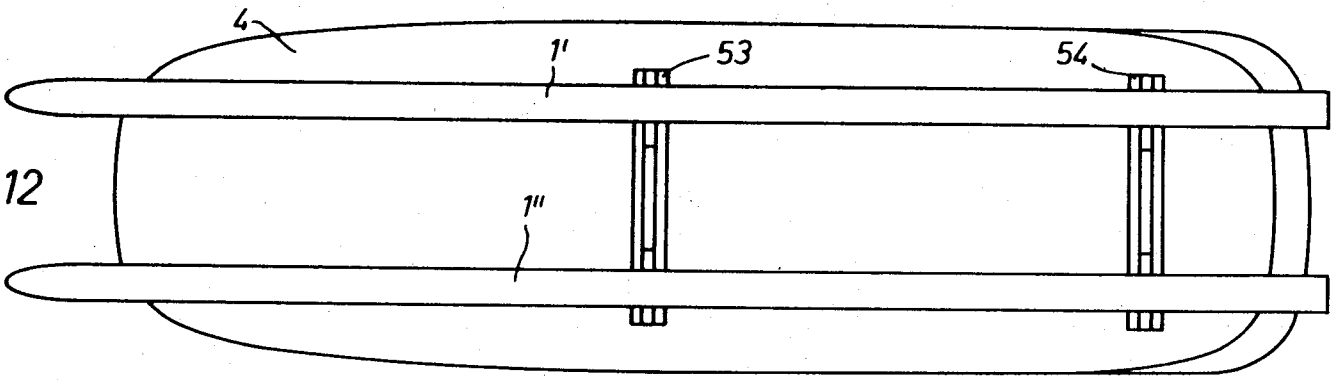
FIG. 12 is a view from underneath an embodiment for cross-country skiing.
Figure 13:
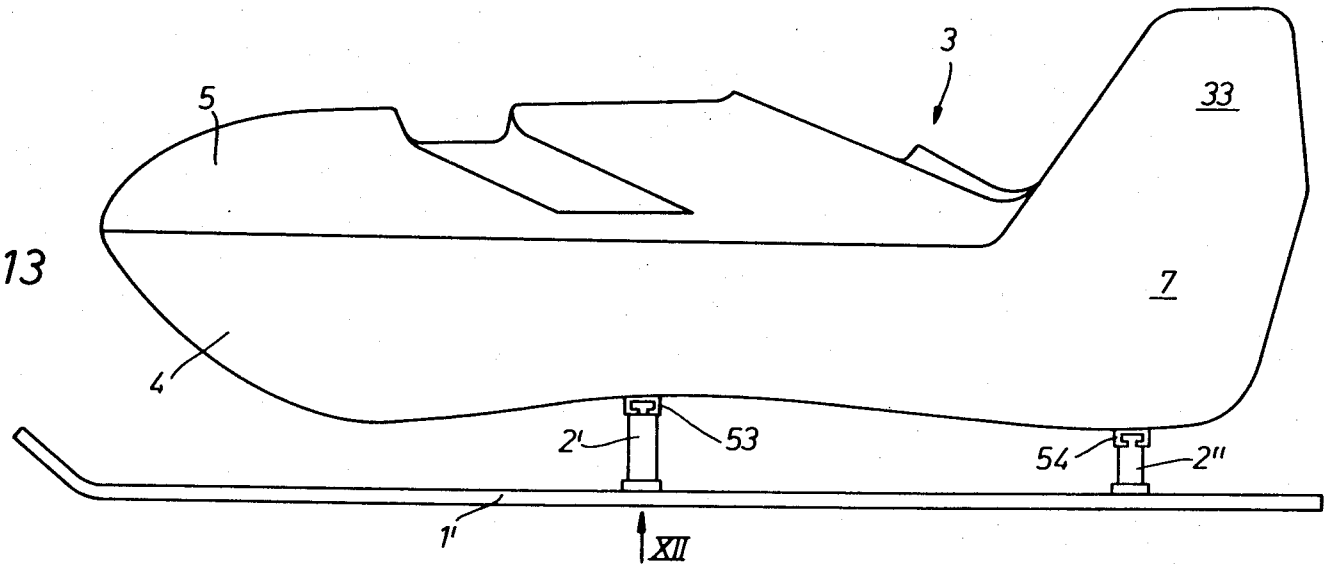
FIG. 13 is a side view of the embodiment of FIG. 12.

FIGS. 12 and 13 show how it is possible to convert the ski for the handicapped into a cross-country apparatus. On the underside of the lower portion 4, two adjusting rails 53, 54 are disposed crosswise and spaced apart from one another, into which two skis 1', 1'', instead of a mono-ski 1, can be inserted via struts 2', 2''. The skis 1', 1'' are spaced apart from one another and are adjustable. To reduce weight, the upper portion 5 can be ommitted for cross-country skiing. In that case, however, seat belts or the like must be disposed in the lower portion, unless they are already provided; for instance, a lap belt similar to that in an automobile can be provided in the seating shell 3, or in the case of a person whose entire lower body is paralyzed a Y belt may be provided, passing between the legs and secured to the rear panel 33 or the side panels 31.

What is claimed is:

1. A ski for the handicapped, comprising:

a mono-ski a seating shell supported on the mono-ski, said seating shell including at least one seating area having a high side panel and a high back panel and a leg supporting area situated in front of the seating shell in the longitudinal direction of the ski for supporting the legs, said seating shell being extended integrally from the seating area to the leg supporting area, said leg supporting area having a knee supporting region for the backs of the knees, and a feet supporting region provided in the front of the seating shell, said knee supporting region being elevated with respect to the seating region and said feet supporting region being lower than the knee supporting region; and a tow and supporting bar assembly including supporting parts pivotably supported at both sides on the seating shell for pivoting between a readiness position and a skiing position, said supporting parts having ends in engagement with the ground to prevent tipping of the ski in the readiness position of the supporting parts relative to the seating shell, a tow bar holder disposed on the front upper end of the tow and supporting bar assembly and releasing means for releasing the tow bar holder from engagement with a T-bar.

2. The ski as defined in claim 1, wherein the seating shell comprises a lower portion and an upper portion removably disposed on the lower portion.

3. The ski as defined in claim 1, wherein the tow and supporting bar assembly further includes a pair of crossbars for joining the supporting parts, and a spring connected to the tow and supporting bar assembly and to the seating shell for biasing the supporting parts into the readiness position.

4. The ski as defined in claim 1, wherein the tow and supporting bar assembly further includes an upper and lower cross bar for joining the supporting parts, and two hooks attached to the upper crossbar serving as the tow bar holder.

5. The ski as defined in claim 1, wherein the tow and supporting bar assembly further includes a tow bar holder housing, and wherein the tow bar holder is mounted to the upper end of the tow and supporting bar to be pivoted counter to the skiing direction and partially lowered into said housing.

6. The ski as defined in claim 5, wherein the seating shell includes an upper portion and where said upper portion serves as said housing.

7. The ski as defined in claim 1, wherein the tow bar holder comprises a belt attached to the upper ends of the supporting parts, said belt including a lock, and wherein the releasing means comprises an opening button which engages said lock.

8. The ski as defined in claim 1, further comprising:

arresting means provided on the seating shell, wherein said arresting means serving to arrest the tow and support bar assembly in a skiing position whereby the tow and support bar assembly rests predominantly on the seating shell.

9. The ski defined in claim 1, further comprising:

a support strut connected to the seating shell and pivotably joined to the mono-ski; and a shock absorber connected to the mono-ski and the seating area of the seating shell, whereby the seating shell may tip about an axis at right angles to the mono-ski.

10. The ski as defined in claim 1, wherein the seating shell comprises fiber-reinforced plastic.

11. The ski as defined in claim 1, further comprising:

a spring band for mounting the seating shell to the mono-ski.

12. The ski as defined in claim 11, wherein the spring band comprises fiber-reinforced plastic.

13. The ski as defined in claim 11, wherein the seating shell comprises a lower portion and an upper portion removably disposed on the lower portion, and wherein the spring band is pivoted at one end to approximately the center of the underside of the lower portion such that it is pivotable away from the lower portion about an axis at right angles to the plane of symmetry of the lower portion, said spring band being secured to the mono-ski at a location spaced apart from its pivoted end.

14. The ski as defined in claim 13, further comprising:

a separate spring band guide mounted at the rounded transition of the underside of the lower portion to the back panel of the seating shell, wherein the spring band includes a non-articulated free end which is guided by said spring band guide, said spring band guide includes a wear-resistant sliding surface for guiding said free end.

15. The ski as defined in claim 11, further comprising:

at least one vibration damper for mounting the spring band to the mono-ski, said vibration damper serving to dampen oscillations about the longitudinal and transverse axes of the seating shell.

16. The ski as defined in claim 15, wherein the vibration damper comprises two U-shaped rails of different width, the opening of which face one another, each rail including a base part and two spaced-apart arms extending from the base part, and wherein an elastomer or rubber bridge is provided between each of the base parts and the arms of the U-shaped rails.

17. The ski as defined in claim 16, wherein the bridge joining the base parts includes a portion engaging the arms of the narrower rail of the U-shaped rails.

18. The ski as defined in claim 15, wherein two spaced apart vibration dampers are provided for mounting the spring band to the mono-ski.

19. The ski as defined in claim 18, wherein the vibration dampers each comprise two U-shaped rails of different width, the openings of which face one another, each rail including a base part, and two spaced-apart arms extending from the base part, and wherein an elastomer or rubber bridge is provided between each of the base parts and the arms of the U-shaped rails.

20. The ski as defined in claim 19, wherein the bridge joining the base parts includes a portion engaging the arms of the narrower rail of the U-shaped rails.

21. The ski as defined in claim 15, wherein the mono-ski includes an adjusting rail, wherein two spaced apart vibration dampers are provided for mounting the spring band to the mono-ski, said dampers being adjustable in the longitudinal direction on the adjusting rail, and wherein the spring band comprises a spring in the form of an arc segment which is mounted to the vibration dampers such that the shape of the arc segment can be variable in the longitudinal direction of the mono-ski.

22. The ski as defined in claim 1, wherein the seating shell comprises a lower portion and an upper portion removably disposed on the lower portion, wherein the tow and supporting bar assembly further includes a spring, wherein the tow bar holder is releasably held on the front upper end of the tow and supporting bar assembly, said supporting parts being pivotable on the lower portion such that they span the upper portion in an arc shape, and wherein in the skiing position said supporting parts rest on the upper side of the upper portion and in the starting position are pivoted away therefrom by said spring to a limiting position at which the ends of the supporting parts engage the ground.

23. The ski as defined in claim 1, wherein the seating shell comprises a lower portion and an upper portion removably disposed on the lower portion, said upper portion including a receiving groove, and wherein part of the supporting parts is lowered into the receiving groove in the skiing position at which time the ends of the support parts engage the lower portion of the shell.

24. The ski as defined in claim 1, wherein the seating shell comprises a lower portion and an upper position removably disposed on the lower portion, wherein the end areas of the supporting parts are each pivotable by a joint for resting against the lower portion in the skiing position, and wherein in the readiness position said supporting parts are pivotably outwardly in order to increase the distance of the support from the vertical of the center of gravity.

25. The ski as defined in claim 1, wherein the releasing means comprises a Bowden cable and button.

26. A ski for the handicapped, comprising:

two skis;

a seating shell including an upper portion, a lower portion, at least one seating area having a high side panel and a high back panel and a leg supporting area situated in the front of the seating shell in the longitudinal direction of the ski for supporting the legs, said seating shell being extended integrally from the seating area to the leg supporting area, said leg supporting area having a knee supporting region for the backs of the knees, and a feet supporting area provided in the front of the seating shell, said knee supporting region being elevated with respect to the seating region and said feet supporting region being lower than the knee supporting region;

a tow and supporting bar assembly including supporting parts pivotably supported at both sides on the seating shell for pivoting between a readiness position and a skiing position, said supporting parts having ends in engagement with the ground to prevent tipping of the ski in the readiness position of the supporting parts relative to the seating shell, a tow bar holder disposed on the front upper end of the tow and supporting bar assembly and releasing means for releasing the tow bar holder from the engagement with a T-bar; and two parallel adjusting rails disposed on the underside of the lower portion for connecting the seating shell to the two skis, such that an adjustable-width retention to the seating shell to the two skis is effected for conversion to cross-country skiing.

* * * * *